US007372419B2

(12) United States Patent
Kim et al.

(10) Patent No.: US 7,372,419 B2
(45) Date of Patent: May 13, 2008

(54) DEVICE FOR SHAPING FLAT-TOPPED ELEMENT PATTERN USING CIRCULAR POLARIZATION MICROSTRIP PATCH

(75) Inventors: Yang-Su Kim, Daejon (KR); Byung-Su Kang, Daejon (KR); Bon-Jun Ku, Daejon (KR); Do-Seob Ahn, Daejon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 188 days.

(21) Appl. No.: 11/211,229

(22) Filed: Aug. 24, 2005

(65) Prior Publication Data

US 2006/0132375 A1 Jun. 22, 2006

(30) Foreign Application Priority Data

Dec. 16, 2004 (KR) ..... 10-2004-0107291

(51) Int. Cl.
*H01Q 13/00* (2006.01)

(52) U.S. Cl. ..... 343/776; 343/772

(58) Field of Classification Search ..... 373/700 MS, 373/786, 772, 776

See application file for complete search history.

(56) References Cited

U.S. PATENT DOCUMENTS 6,891,513 B2 * 5/2005 Kienzle et al. ..... 343/786
7,019,707 B2 * 3/2006 Gottwald et al. ..... 343/786
2005/0110695 A1 * 5/2005 Jung et al. ..... 343/786
2006/0139209 A1 * 6/2006 Tanaka et al. ..... 343/700 MS

FOREIGN PATENT DOCUMENTS

KR 20030071996 9/2003
KR 10-20050066904 6/2005

OTHER PUBLICATIONS

'Methods of Constructing Optimum Phased-Array Antennas for Limited Field of View' Skobelev, IEEE Antennas and Propagation Magazine, vol. 40, No. 2, Apr. 1998, pp. 39-49.

* cited by examiner

*Primary Examiner*—Hoanganh Le
(74) *Attorney, Agent, or Firm*—Ladas & Parry LLP

(57) ABSTRACT

Provided is a device for shaping a flat-topped element pattern using a circular polarization microstrip patch. The device includes: a microstrip patch feeding unit for generating circularly polarized signals of a basic mode; a circular waveguide for guiding the circular polarized signals and generating signals of high-order modes; and a pattern shaping unit for shaping FTEP through an electromagnetic mutual coupling between the signals of the high-order modes generated from the pattern shaping unit.

6 Claims, 3 Drawing Sheets

DEVICE FOR SHAPING FLAT-TOPPED ELEMENT PATTERN USING CIRCULAR POLARIZATION MICROSTRIP PATCH

FIELD OF THE INVENTION

The present invention relates to a device for shaping a flat-topped element pattern using a circular polarization microstrip patch; and, more particularly, to a device for shaping a flat-topped element pattern using a circular polarization microstrip patch, in which a flat-topped element pattern is shaped by directly generating a circular polarization signal of a basic mode using a microstrip patch feeding unit instead of a separate polarizer, thereby applying to a wide beam scanning and reducing size and weight thereof.

DESCRIPTION OF RELATED ART

A flat-topped element pattern (FTEP) means a rectangular beam pattern of an antenna. The FTEP technology can minimize the number of phase control elements in an array antenna system. Accordingly, the FTEP technology is widely used in the array antenna systems.

The phase control elements are essential and expensive parts in the development of the phased array antennas. The number of the phase control elements to be mounted is determined by requirement specifications such as antenna array gain, side lobe level, and sector beam scanning. The antenna array gain and the side lobe level are used to determine the shape or size of array aperture, and the sector beam scanning is used to determine the interval of the array elements.

In order for a wide beam scanning in designing the array of the phase control elements using a conventional method, the maximum array interval of the phase control elements is determined such that a grating lobe for the array factor cannot exist in a real space.

On the contrary, since the FTEP technology has a relatively narrow beam scanning range (±5-25°), the maximum array interval can be determined so that the grating lobe due to the array factor can exist in a real space. Also, the grating lobe can be suppressed by the side lobe characteristic of the FTEP.

Accordingly, compared with the conventional method, the FTEP technology can relatively increase the interval of the phase control elements, thereby minimizing the number of the phase control elements. For example, if the FTEP technology is used in the design of the phase array requiring a 20° conical beam scanning, the number of the phase control elements can be reduced by 1/11.

In order to shape the FTEP within the required scanning range, the characteristic of the array aperture amplitude distribution must have the overlapped subarray characteristic and must also satisfy the array characteristics due to sin x/x in one-dimensional array, $$\frac{\sin x}{x}\frac{\sin y}{y}$$

in two-dimensional array, and $$\frac{J_1(x)}{x}$$

in three-dimensional array.

A passive multi-terminal network array structure, a linear array scanning structure in an electric field (E) or magnetic field (H)-plane, a corrugated waveguide array structure, a pseudo optical network array structure, and a two-dimensional multilayer circular radiation array structure are used for shaping the FTEP having the above-described characteristics.

In the case of the passive multi-terminal network array structure, however, a complicated feeding network causes a degradation of efficiency in a two-dimensional beam scanning. Also, the passive multi-terminal network array structure has a problem in that it is bulky and heavy and increases the price of the system. The linear array scanning structure in an electric field (E) or magnetic field (H)-plane has a relatively narrow bandwidth and narrow beam scanning range and is also limited to the one-dimensional application. Also, the corrugated waveguide array structure is relatively heavy at a low frequency and a dielectric material is expensive, thus increasing the price of the system. Temperature change between dielectrics and characteristic according to the dielectric products are so sensitive that the performance of the antenna is non-uniform. The pseudo optical network array structure requires a plurality of phase shifters and 3% or more design of the array antenna is impossible. Also, it is bulky and heavy and the price of the system is high. The two-dimensional multilayer circular radiation array structure is limited to the very narrow beam scanning of the large-scaled array antenna.

Accordingly, in order to solve the problems of the prior art, a conventional FTEP shaping device using a dielectric rod having a hexagonal array structure is shown in FIG. 1.

Referring to FIG. 1, the conventional FTEP shaping device includes a linear polarization feeding unit 110 and a polarizer 120 for generating linearly polarized waves within a circular waveguide so as to generate circularly polarized waves, and a dielectric rod 130 having a hexagonal array structure using a strong electromagnetic mutual coupling.

The structure shown in FIG. 1 can reduce the number of radiation elements compared with the above-described five structures, thereby reducing the cost and the feeding loss. Also, since it is applicable to the two-dimensional application, it can be applied to a relatively wide beam scanning.

However, due to the use of the linear polarization feeding unit 110 and the polarizer 120 for feeding the circularly polarized signals, its fabrication is complicated and the system becomes bulk and heavy.

SUMMARY OF THE INVENTION

It is, therefore, an object of the present invention to provide a device for shaping a flat-topped element pattern using a circular polarization microstrip patch, in which a flat-topped element pattern is shaped by directly generating a circular polarization signal of a basic mode using a microstrip patch feeding unit instead of a separate polarizer, thereby applying to a wide beam scanning and reducing size and weight thereof.

In accordance with an aspect of the present invention, there is provided a device for shaping a flat-topped element pattern (FTEP), including: a microstrip patch feeding unit for generating circularly polarized signals of a basic mode; a circular waveguide for guiding the circular polarized signals and generating signals of high-order modes; and a pattern shaping unit for shaping FTEP through an electromagnetic mutual coupling between the signals of the high-order modes generated from the pattern shaping unit.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE INVENTION

Other objects and aspects of the invention will become apparent from the following description of the embodiments with reference to the accompanying drawings, which is set forth hereinafter.

Figure 1:
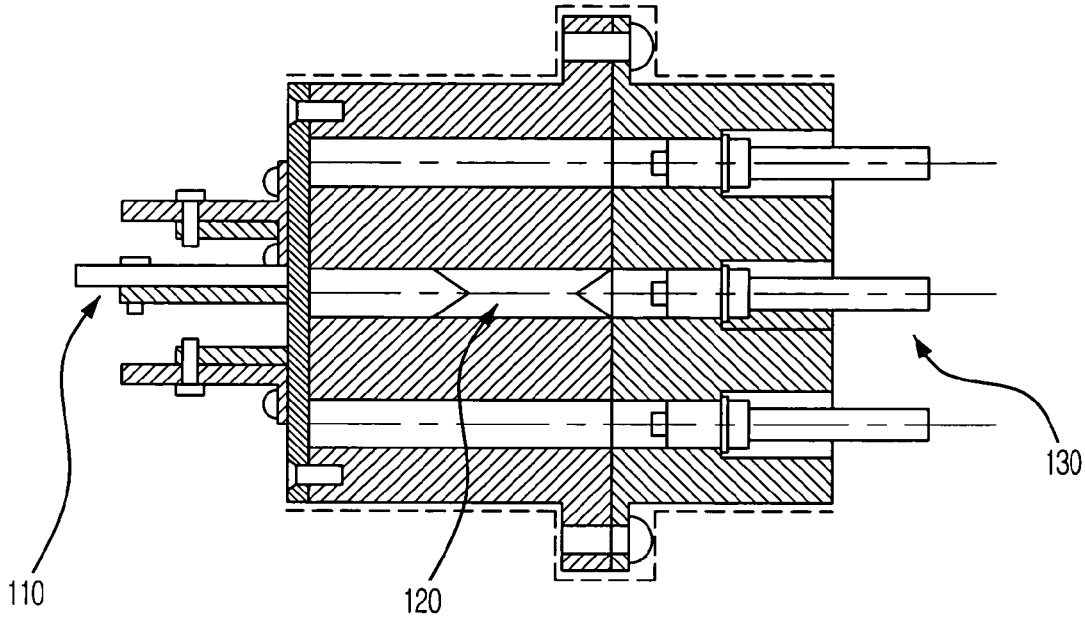
FIG. 1 (PRIOR ART)
FIG. 1 is a sectional view of a conventional device for shaping a flat-topped element pattern.
Figure 2:
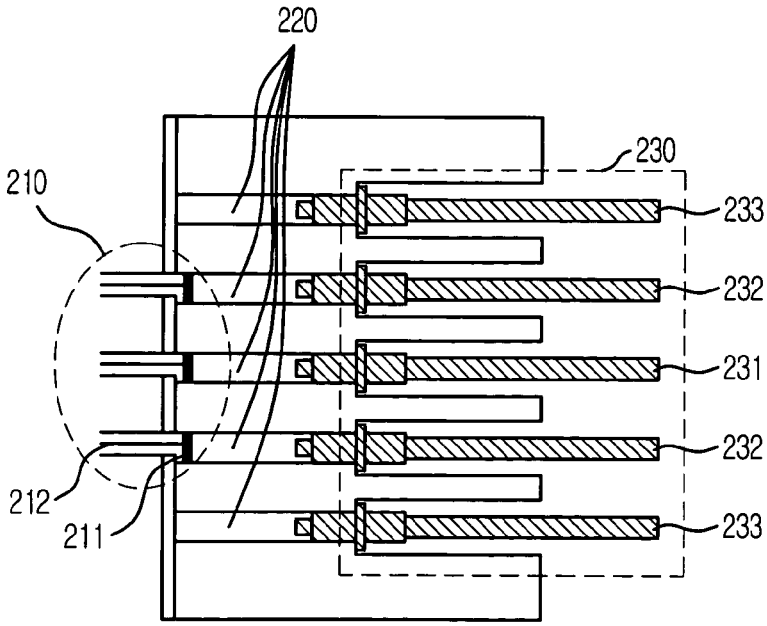
FIG. 2 is a sectional view of a device for shaping a flat-topped element pattern using a circular polarization microstrip patch in accordance with an embodiment of the present invention.

FIG. 2 is a sectional view of a device for shaping a flat-topped element pattern (FTEP) using a circular polarization microstrip patch in accordance with an embodiment of the present invention.

Referring to FIG. 2, the FTEP shaping device includes a microstrip patch feeding unit 210, a circular waveguide 220, and a pattern shaping unit 230.

The microstrip path feeding unit 210 generates circularly polarized signals of a basic mode. The microstrip path feeding unit 210 includes a plurality of microstrip patches and a plurality of feeding lines.

The microstrip patch feeding unit 210 will be described below in detail with reference to FIG. 3. For the sake's of convenience, one microstrip patch connected to one circular waveguide will be described.

Figure 3:
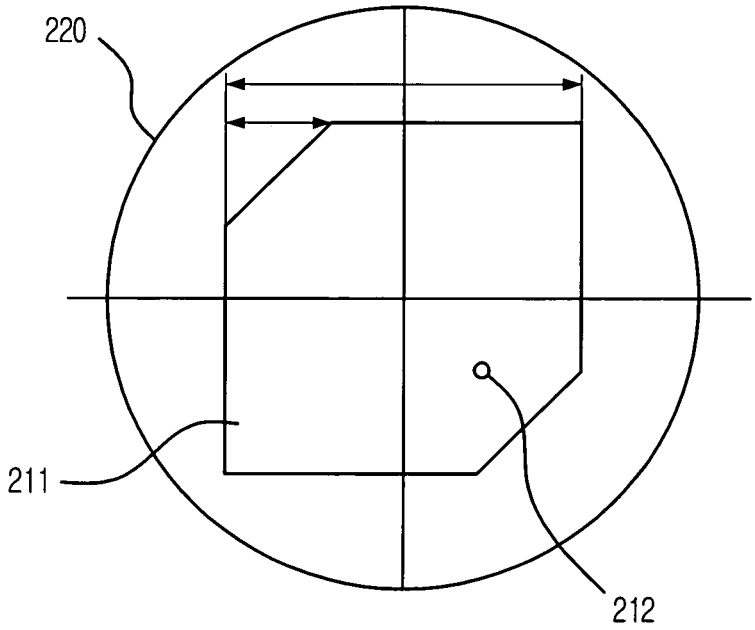
FIG. 3 is an exemplary diagram of a microstrip patch feeding unit in accordance with an embodiment of the present invention.

Referring to FIG. 3, the microstrip patch feeding unit 210 includes a microstrip patch 211 and a feeding line 212 and is vertically arranged within the circular waveguide 220. Accordingly, the microstrip patch 211 is inserted into the circular waveguide 220 and generates circularly polarized signals using the signals fed through the feeding line 212.

The circularly polarized signal determines frequency, axial ratio and reflection loss according to a length L of the microstrip patch 211, a length dl of a perturbation, and a position of the feeding line 212.

Accordingly, the length L of the microstrip patch 211, the length dl of the perturbation, and the position of the feeding line 212 are not determined with one value, but can be varied according to the specification of the systems using the circularly polarized signals.

Although a rectangular microstrip patch 211 is shown in FIG. 3, the present invention is not limited to this shape. That is, any microstrip patch that can generate the circularly polarized waves can be used.

The circular waveguide 220 guides the circularly polarized signals of the basic mode generated from the microstrip patch feeding unit 210 and generates signals of high-order mode.

The pattern shaping unit 230 shapes flat-topped element patterns through the electromagnetic mutual coupling between signals of high-order mode generated from the circular waveguide 220.

At this time, the pattern shaping unit 230 includes: N number of rings, N being a positive integer greater than 1, each ring comprised of a plurality of ring elements that are disposed around the central element. Elements included the in the first to (N−1)th rings and the central element form the flat-topped element pattern through the electromagnetic mutual coupling of the high-order signals received through the circular waveguide 220; and 6N elements of the Nth ring mounted at regular intervals from the FTEP by the electromagnetic mutual coupling with the adjacent ring elements; and a support member for supporting the central element, the element included in the first to the (N−1)th ring and the 6N elements of the Nth ring.

When N=2, the pattern shaping unit 230 will be described in detail with reference to FIGS. 4A and 4B.

Figure 4A:
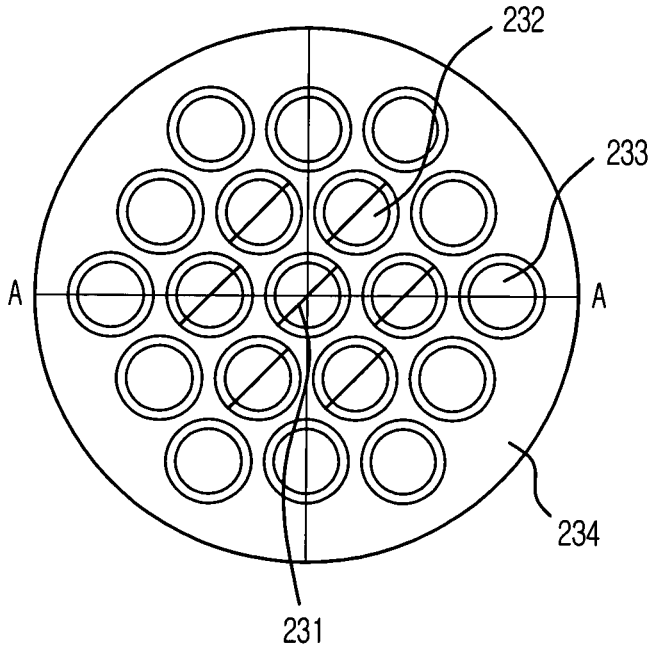
FIG. 4A is a top view of a device for shaping a flat-topped element pattern using a circular polarization microstrip patch in accordance with the present invention.
Figure 4B:
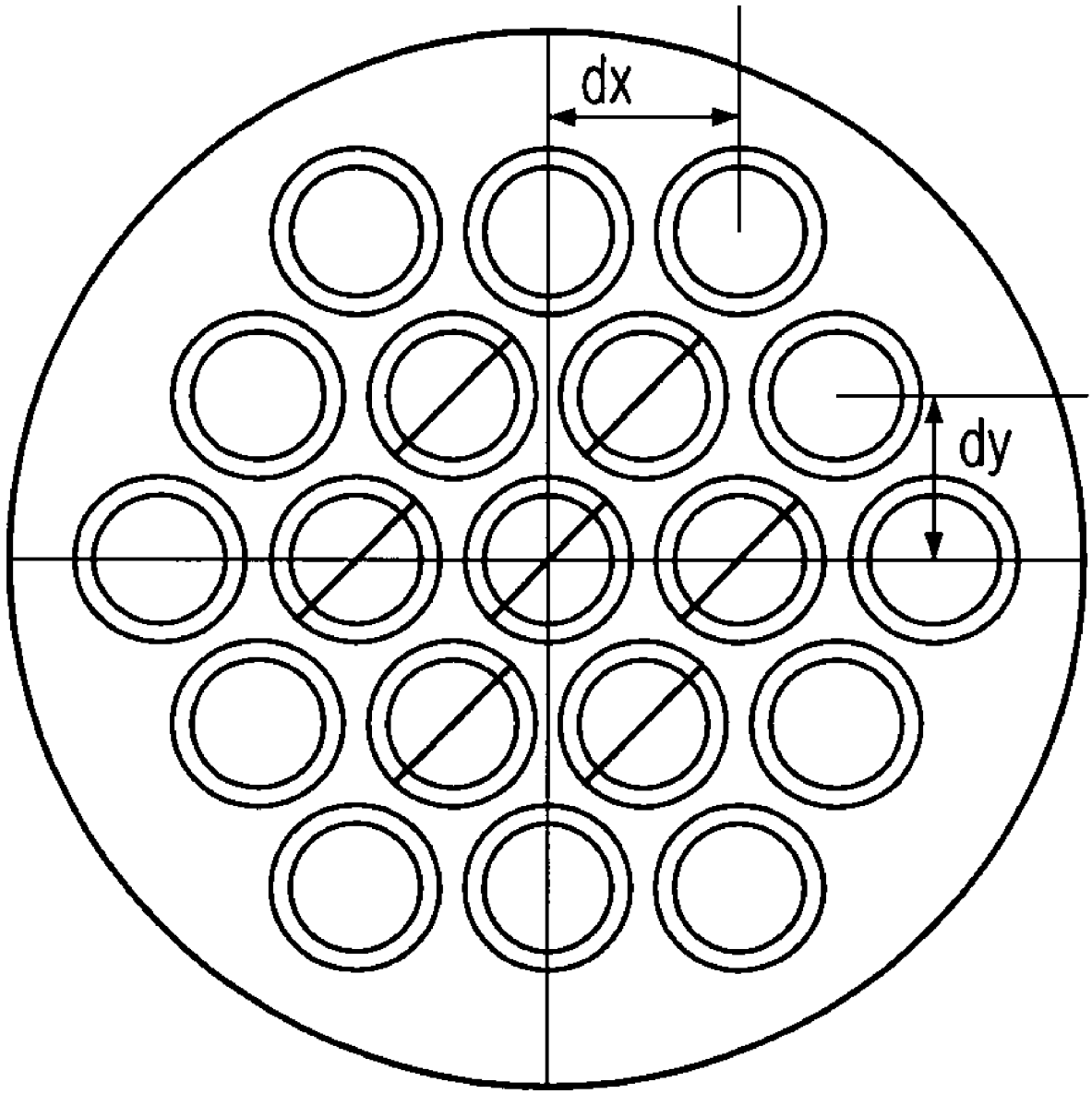
FIG. 4B is a top view of a pattern shaping unit in accordance with an embodiment of the present invention.

Referring to FIG. 4A, the pattern shaping unit 230 includes a central element 231, a first ring element 232 (i.e. N−1=), a second ring element 233 (i.e., N=2), and a support member 234.

The pattern shaping unit 230 is provided with one central element 231, six first ring elements 232 (i.e., N−1=1), and twelve second ring elements 233 (i.e., N=2). The central element 231 and the first ring elements 232 (i.e., N−1=1) are electromagnetically coupled to the second ring elements 233 (i.e., N=2) to shape unit radiation pattern of the FTEP. That is, FIG. 4A shows two (N=2) rings where N is a positive integer greater than 1. The first ring (N−1=1) includes 6N or 6 ring elements, and the second ring (N=2) includes 6N or 12 ring elements. Then. 6(N−1) number (i.e., 6) of ring elements are mounted for the first ring (i.e., first to the (N−1)th ring where N=2) for shaping unit radiation pattern of the flat-topped element pattern through the electromagnetic mutual coupling of the high-order signals received through the circular waveguide 220. 6N number (i.e., 12) of ring elements are mounted for the second ring (i.e., the Nth ring) for shaping unit radiation pattern through the electromagnetic mutual coupling with the adjacent ring elements.

At this time, the central element 231 shapes unit radiation pattern using the signals received through the circular waveguide 220.

The first ring elements 232 (N−1=1) are disposed at vertexes of the regular hexagon whose center is the central element 231. The first ring elements 232 shape the FTEP through the electromagnetic mutual coupling with the central element 231.

The second ring elements 233 (N=2) are disposed at the remaining vertexes of regular triangular lattices whose vertexes are formed by one or two first ring elements 232. The second ring elements form the regular hexagonal shape and are mutually coupled to the central element and the first ring elements 232 to thereby form the FTEP.

The positions of the first ring elements 232 (N−1=1) and the second ring elements 233 (N=2) will be described below with reference to FIG. 4B.

The first ring elements 232 include six regular hexagonal elements disposed around the central element 231 and a distance between them is dx and dy.

Accordingly, the positions of the first ring elements 232 are (dx, 0), (−dx, 0), (dx/2, dy), (−dx/2, dy), (dx/2, −dy), and (−dx/2, −dy) in xy coordinate.

The second ring elements 233 are disposed at the remaining vertexes of regular triangular lattices whose vertexes are formed by one or two first ring elements 232, and they form a second regular hexagonal shape from the central element 231. Like the first ring elements, a distance between the second ring elements is dx and dy.

Accordingly, the positions of the second ring elements are (2dx, 0), (−2dx, 0), (3dx/2, dy), (−3dx/2, dy), (3dx/2, −dy), (−3dx/2, −dy), (dx, 2dy), (−dx, 2dy), (dx, −2dy), (−dx, −2dy), (0, 2dy), and (0, −2dy).

The support member 234 supports the central element 231, the first ring elements 232, and the second ring elements 233.

The microstrip patch for generating the circularly polarized waves is vertically provided within the circular waveguide connected to the central element 231 and the six first ring elements 232. However, the microstrip patch is not provided within the inside of the circular waveguide connected to twelve second ring elements 233.

As described above, by using the dielectric rods having the hexagonal array structure in the FTEP shaping device, the grating lobe is suppressed and the number of radiation elements is reduced. Accordingly, the cost and the feeding loss can be reduced and thus the inventive device can be applied to a relatively wide beam scanning.

Also, since the inventive device directly generates the circularly polarized signals of the basic mode using the microstrip patch feeding unit instead of a separate polarizer, its size and weight can be reduced. Further, the inventive device can be fabricated easily and lightly at a millimeter wave band (about 10 GHz or more).

The present application contains subject matter related to Korean patent application No. 2004-0107291, filed with the Korean Intellectual Property Office on Dec. 16, 2004, the entire contents of which is incorporated herein by reference.

While the present invention has been described with respect to certain preferred embodiments, it will be apparent to those skilled in the art that various changes and modifications may be made without departing from the scope of the invention as defined in the following claims.

What is claimed is:

1. A device for shaping a flat-topped element pattern (FTEP), comprising:

a microstrip patch feeding unit for generating circularly polarized signals of a basic mode;

a circular waveguide for guiding the circularly polarized signals of a basic mode and generating signals of high-order modes; and a pattern shaping unit for shaping FTEP by an electromagnetic mutual coupling between the signals of the high-order modes generated from the circular waveguide.

2. The device as recited in claim 1, wherein the microstrip patch feeding unit includes:

a predetermined number of microstrip patches for generating the circularly polarized signals using signals fed through a feeding line; and a predetermined number of feeding lines for transferring an input signal to the microstrip patches.

3. The device as recited in claim 1, wherein the pattern shaping unit includes:

a central element for shaping unit radiation pattern using the signals received through the circular waveguide;

a plurality of first ring elements for shaping FTEP by an electromagnetic mutual coupling with the central element;

a plurality of second ring elements for shaping FTEP by a mutual coupling with the central element and the first ring elements; and a support member for supporting the central element, the first ring elements and the second ring elements.

4. The device as recited in claim 3, wherein the first ring elements are disposed at vertexes of a regular hexagon whose center is the central element.

5. The device as recited in claim 3, wherein the second ring elements are disposed at the remaining vertexes of regular triangular lattices whose vertexes are formed by one or two first ring elements.

6. The device as recited in claim 1, wherein the pattern shaping unit includes:

a central element and N rings, N being a positive integer greater than 1, wherein elements include in first to (N−1)th rings and the central element form the FTEP by the electromagnetic mutual coupling of the high-order signals received through the circular waveguide; and wherein 6N elements of a Nth ring mounted at regular intervals form the FTEP by the electromagnetic mutual coupling with adjacent elements; and a support member for supporting the central element, elements included in the first to the (N−1)th rings and the 6N elements of the Nth ring.

* * * * *